US005993136A

United States Patent [19]

Vickary

[11] Patent Number: 5,993,136

[45] Date of Patent: Nov. 30, 1999

[54] MOBIL LIFT AND STORAGE APPARATUS

[76] Inventor: Coleman W. Vickary, P.O. Box 164, Central Bridge, N.Y. 12035

[21] Appl. No.: 09/257,559

[22] Filed: Feb. 25, 1999

[51] Int. Cl.[6] ..... B66C 23/36

[52] U.S. Cl. ..... 414/543; 414/626; 414/673

[58] Field of Search ..... 414/543, 540, 414/541, 348, 626, 673

[56] References Cited

U.S. PATENT DOCUMENTS

| | | | |
|---|---|---|---|
| 760,151 | 10/1904 | Faure et al. . | |
| 864,936 | 9/1907 | Taylor | 414/673 X |
| 2,518,776 | 8/1950 | Hampton et al. . | |
| 2,589,915 | 3/1952 | Wullschleger . | |
| 2,940,621 | 6/1960 | White | 414/543 |
| 2,989,197 | 6/1961 | Werner et al. | 414/543 X |
| 3,282,450 | 11/1966 | Atcheson | 414/543 |
| 4,249,853 | 2/1981 | Lyvers | 414/543 |
| 4,329,795 | 5/1982 | Kalve | 37/116 |
| 4,387,814 | 6/1983 | Beduhn et al. | 212/195 |
| 4,419,038 | 12/1983 | Pendergraft | 414/543 |
| 4,588,346 | 5/1986 | Smith | 414/673 |
| 4,850,782 | 7/1989 | Focke | 414/673 X |
| 5,064,334 | 11/1991 | Cooley | 414/428 |
| 5,145,311 | 9/1992 | Salvucci . | |
| 5,256,122 | 10/1993 | Deden | 482/99 |
| 5,348,172 | 9/1994 | Wilson . | |
| 5,423,652 | 6/1995 | Thiede | 414/543 |
| 5,752,799 | 5/1998 | Carey et al. | 414/543 |
| 5,800,117 | 9/1998 | Milton | 414/540 |
| 5,810,547 | 9/1998 | Bruno et al. | 414/543 |

*Primary Examiner*—David A. Bucci
*Assistant Examiner*—Gerald O'Connor
*Attorney, Agent, or Firm*—Schmeiser, Olsen & Watts

[57] ABSTRACT

A mobile lift and storage apparatus for lifting, lowering, moving, and storing objects. A combination of the mobile lift and a stationary storage apparatus forming a stationary storage system for securing the mobile lift and the stored objects.

12 Claims, 12 Drawing Sheets

MOBIL LIFT AND STORAGE APPARATUS

FIELD OF THE INVENTION

The present invention relates generally to lifting and storage devices, and more particularly relates to a mobile lift and a stationary storage apparatus for lifting and storing objects such as liquid petroleum gas cylinders.

BACKGROUND OF THE INVENTION

Mobile lifts are well known in the art. The mobile lift allows an operator to lift a heavy object safely without causing back injuries. Also, the mobile lift can assist the operator in lifting loads heavier than the operator can physically lift without assistance. Storage racks and shelves are well known in the art for storing objects.

Mobile lifts typically include a boom pivotally mounted on a support structure. Commonly, the support structure is mounted on wheels for allowing the mobile lift to be easily moved. Many mobile lifts typically include a lift cable passing over the end of the boom. A first end of the lift cable is attached to the object to be lifted, and a second end of the lift cable is attached to a winch or to a counterweight apparatus. The counterweight can be adjusted to be essentially about the same weight as the weight of the object being lifted. Since the weight being lifted is essentially counterbalanced by the counterweight, the operator can easily lift the object, because the operator is only lifting a small portion of the total weight of the object. When the object weight changes, the operator is required to lift and to remove or add different counterweights. This lifting of the counterweights can cause back injuries to the operator.

Many fork lift trucks are powered by engines that are fueled by liquid petroleum (LP) gas or propane. The gas is typically stored in a container commonly referred to as a "cylinder." The cylinders are removably attached to a platform on one end of the fork lift truck. Commonly, the cylinders are located four or more feet above the ground. When empty, an LP tank must be manually lowered from the fork lift truck platform to the floor. Next, a filled cylinder must be manually lifted to the fork lift truck platform.

Additionally, the empty and full cylinders must be carried to and from a central storage rack where the cylinders are safely stored. Since each filled cylinder weighs between about 60 and 80 pounds, there is a risk of injury to the operator when lifting and moving the cylinder. Furthermore, some operators may not be physically strong enough to lift and move the cylinder.

SUMMARY OF THE INVENTION

The present invention provides a mobile lift for lifting, lowering, and moving objects. Additionally, the mobile lift combines with a stationary storage apparatus to provide a secure stationary storage system. The stationary storage system provides secure tamper resistant storage for objects and for the mobile lift. In a preferred embodiment of the present invention, the mobile lift transports, lifts, and lowers cylinders. Furthermore, the mobile lift combines with a stationary storage apparatus to provide a safe and secure stationary storage system for both the cylinders and for the mobile lift.

The mobile lift includes a main body, a boom apparatus, a counterweight apparatus, wheel assemblies, a lift cable, and a tong apparatus. Included in the main body is a tower assembly including a main wall. The main wall includes a fence that provides a removable wall for the storage apparatus. A push handle and the boom apparatus are attached to the tower assembly.

The counterweight apparatus includes two vertical guides, a pivot post, a counterweight support, a counterweight carrier, and a plurality of counterweights. Each counterweight has a centrally located hole. Counterweights are stacked and stored with the pivot post passing through the hole in each counterweight. The total weight attached to a second end of the lift cable is determined by adding the counterweight carrier weight to the combined weight of the individual counterweights that are supported by the counterweight carrier.

The counterweight carrier moves in a vertical direction and rides in the vertical guides included in the tower assembly. The counterweights are supported on hooks located in a bottom portion of the counterweight carrier. In order to obtain a desired total counterweight, the operator can select one or more counterweights to be lifted by the hooks. Each counterweight is selected for lifting by rotating the counterweight in a predetermined (e.g., clockwise) direction. Each counterweight can be rotated in an opposite (e.g., counter-clockwise) direction to deselect the counterweight for lifting. The selection process is accomplished in the lower section of the guides where there are openings to allow the counterweights to be rotated. Therefore, in the present invention, the operator engages counterweights by rotation and never has to lift the counterweights. This prevents back injuries and allows operators that are not physically strong to handle the counterweights. The combined weight of the counterweight carrier and the selected counterweights are preferably about the same weight of the cylinder being lifted. Individually selected counterweights provide weight compensation for a full, empty, or partially full cylinder.

The tong apparatus includes a tong main body and hook arms. The tong main body includes a guidance handle and a loop for attachment to a first end of the lift cable. The guidance handle is grasped by the operator and is used to lift, lower and rotate the cylinder into the desired location. Two hook arms are pivotally attached to the tong main body. The tong main body includes a plurality of holes to enable the pivot locations for the hook arms to be moved in order to accommodate different cylinder lengths. Each hook arm includes a control handle and a cylinder hook. The hook arms pivot in an inward direction to engage the ends of the cylinder with the cylinder hooks. When the operator lifts the cylinder using the guidance handle, the counterweight apparatus attached to the second end of the lift cable counterbalances the weight of the cylinder. Empty cylinders commonly weigh between about 27 to 35 pounds, and full cylinders commonly weigh between about 60 to 80 pounds. Counterweights are selected to counterbalance all but about 10 pounds of the total weight of the cylinder. For stability and control, this ensures that the cylinder, if left unattended, will always safely return to the ground. At the same time, the operator only has to provide a minimal amount of force to lift the cylinder. The operator releases the cylinder hooks from engagement with the cylinder by lifting each control handle in an upward direction.

The boom apparatus is attached to the tower assembly of the main body. The boom apparatus includes a boom arm, a pivot support assembly, a first sheave, a second sheave, a support plate, and a wheel assembly. The boom arm can be rotated 360 degrees about the pivot support assembly and is further supported by a wheel assembly including a boom support wheel that contacts the support plate. The lift cable passes over the first and second sheave, and passes through a central hole in the pivot support assembly.

A plurality of cradles attached to a main frame of the mobile lift provides storage for full and empty cylinders. In accordance with the present invention, the operator rotates the boom into a position over the cylinder to be lifted. The operator rotates the required counterweights for engagement with the hooks of the counterweight carrier. The selected counterweights counterbalance the weight of the cylinder. Next, the operator engages the cylinder hooks of the tong apparatus onto each end of the cylinder. By grasping the guidance handle of the tong apparatus, the operator lifts, moves, and lowers the cylinder to cradles attached on the main frame. Next, the operator grasps the push handle attached to the mobile lift and moves the mobile lift to a location where the cylinder is required. Wheel assemblies including pivotally mounted wheel, are attached to the main frame to facilitate the movement of the mobile lift. A foot brake assembly is attached to one end of the main frame. The operator can use the foot brake assembly to hold the mobile lift in a fixed location.

If the operator is replacing an empty cylinder on a fork lift truck, the operator engages the cylinder hooks of the tong apparatus onto each end of the empty cylinder on the fork lift truck. The operator grasps the guidance handle of the tong apparatus and lifts, moves, and lowers the empty cylinder to empty cradles on the main frame. The swiveling boom allows the operator to easily move the empty cylinder from a location above the fork lift truck to a location above the empty cradles on the main frame. Next, the operator reverses the process and uses the mobile lift to lift and move a full cylinder from the cradles on the main frame to the platform on the fork lift truck.

The operator then rolls the mobile lift to a stationary storage apparatus. The stationary storage apparatus provides a secure location where empty and full cylinders can be stored. The stationary storage apparatus includes a plurality of racks with a plurality of cradles to support and receive the cylinders. The racks, cradles, and cylinders are located inside of a housing of the stationary storage apparatus. The housing includes a single opening for receiving a portion of the mobile lift. The operator uses the mobile lift to move cylinders to and from the mobile lift and the stationary storage apparatus.

Included in the tower assembly of the main body of the mobile lift is a main wall that includes a fence. The operator rolls the main lift into the opening in the housing of the stationary storage apparatus until the main wall of the mobile lift contacts the housing of the stationary storage apparatus. The main wall of the mobile lift contacts the housing of the stationary storage apparatus, thereby sealing the opening in the housing. Specifically, the cylinders on the mobile lift, and the cylinders on the racks of the stationary storage apparatus are sealed within the housing. Therefore, if the main wall of the mobile lift is locked to the housing, both the mobile lift and the cylinders are secured in a tamper proof manner. The combination of the mobile lift and the stationary storage apparatus form a secure stationary storage system. Thus, the cylinders are safely secured within the housing, and the mobile lift is locked to the stationary storage apparatus, so that the mobile lift cannot be rolled away and stolen.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
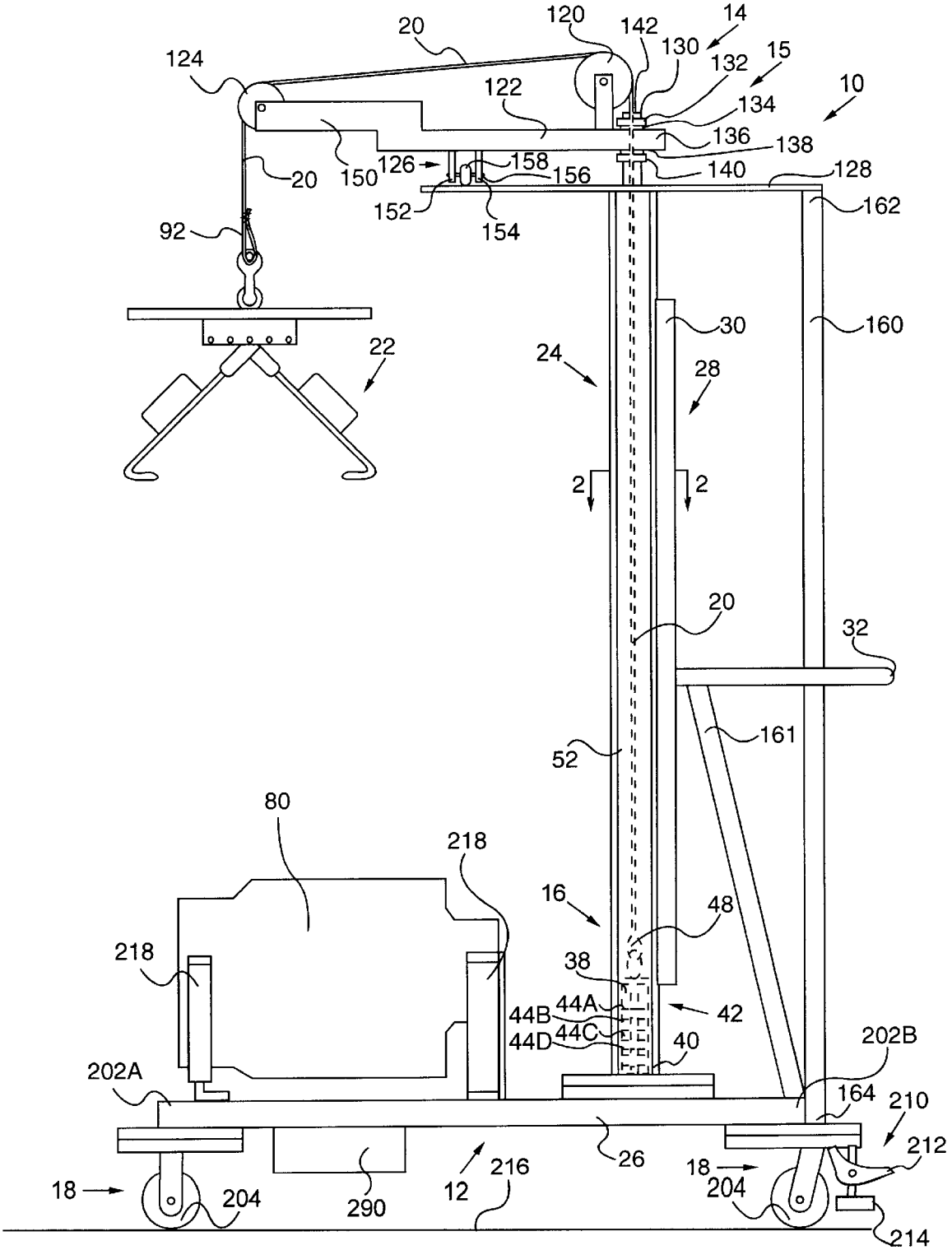
FIG. 1 illustrates a side view of a mobile lift according to a preferred embodiment of the present invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings.

Figure 2:
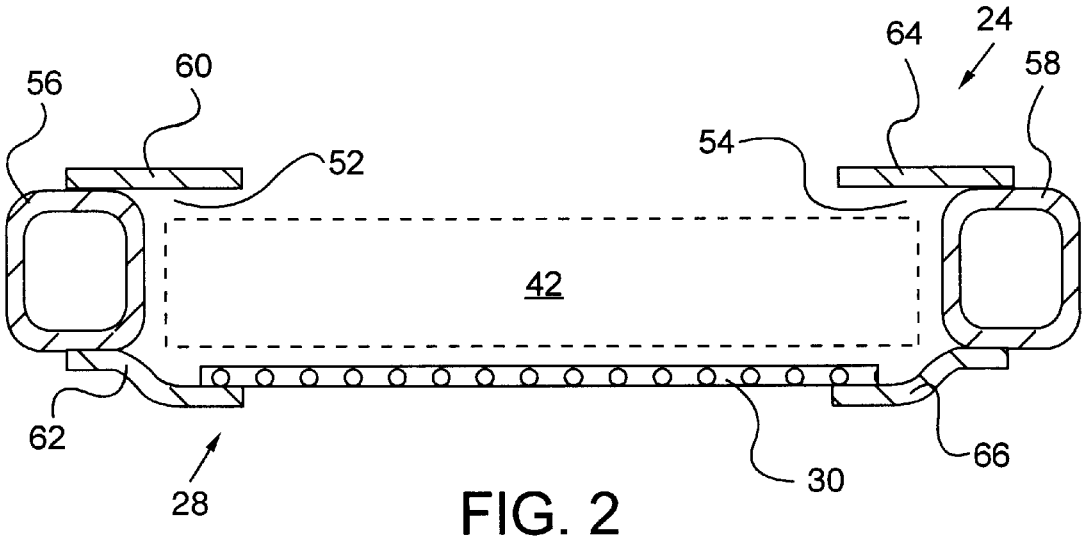
FIG. 2 illustrates a cross-sectional view of a tower assembly of the mobile lift taken along line 2—2 of FIG. 1.

Referring to FIG. 1, there is illustrated a side view of a mobile lift 10 according to a preferred embodiment of the present invention. The mobile lift 10 includes a main body 12, a boom apparatus 14, a counterweight apparatus 16, wheel assemblies 18, a lift cable 20, and a tong apparatus 22. Included in the main body 12 is a tower assembly 24 attached to a main frame 26. The tower assembly 24 includes a main wall 28 including a fence 30 (FIG. 2). As illustrated in FIG. 1, a push handle 32 and the boom apparatus 14 are attached to the tower assembly 24.

Figure 3:
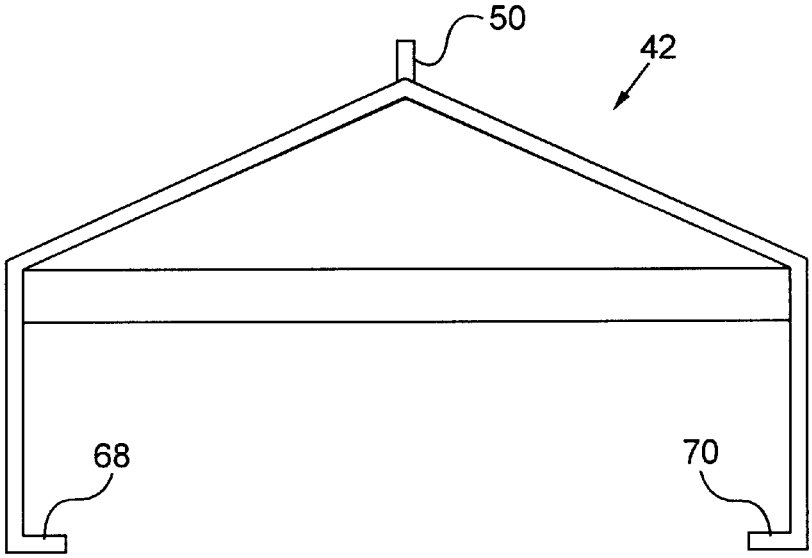
FIG. 3 illustrates a side view of a counterweight carrier.
Figure 4:
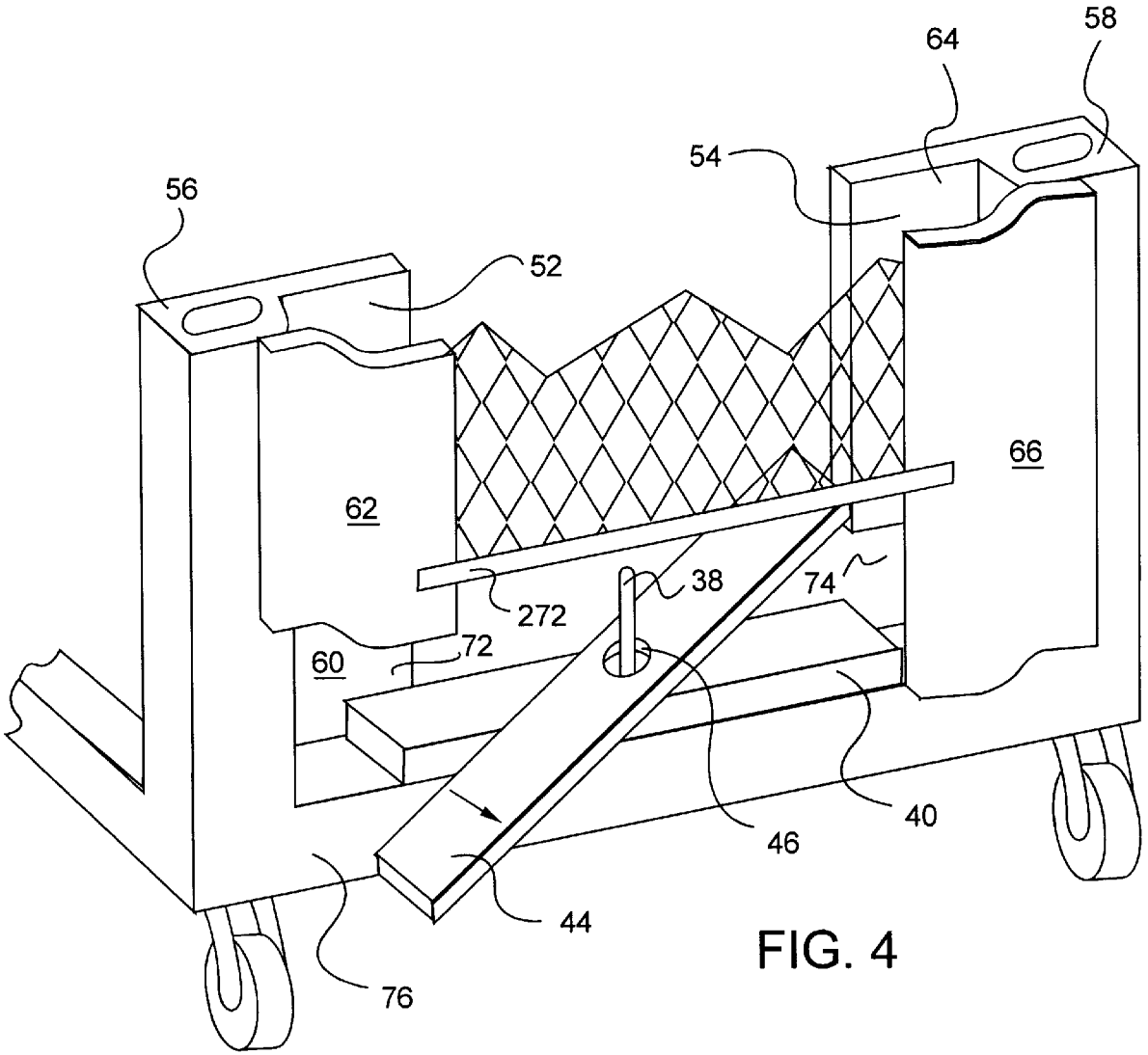
FIG. 4 illustrates a perspective view of a plurality of rotatable counterweights.
Figure 5:
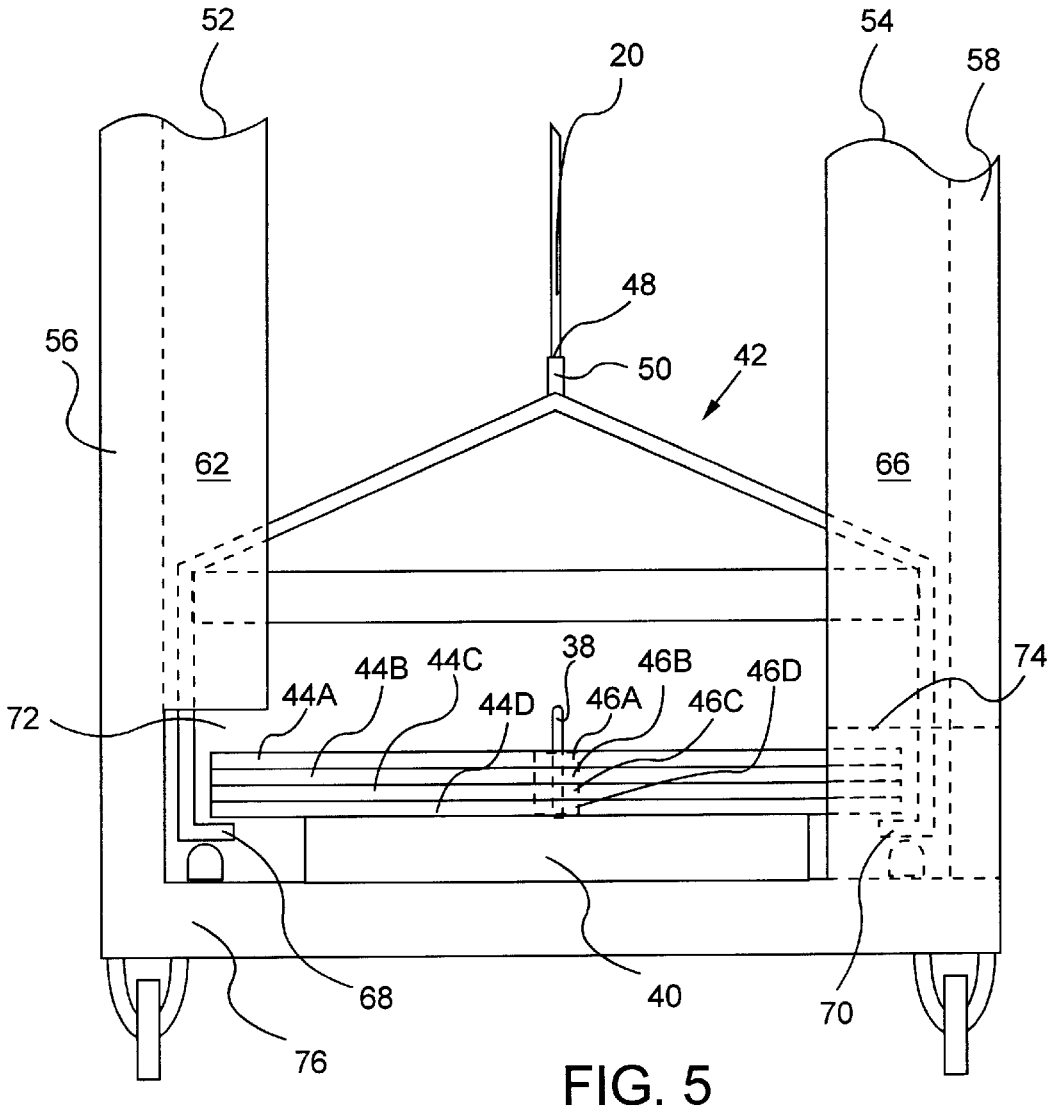
FIG. 5 illustrates a side view of the counterweights and counterweight carrier.

The counterweight apparatus 16 is illustrated in FIGS. 1 through 5. The counterweight apparatus 16 includes a vertical guide 52 and a vertical guide 54. In addition, the counterweight apparatus 16 includes a pivot post 38, a counterweight support 40, a counter weight carrier 42, and a plurality of counterweights 44A, 44B, 44C, and 44D (FIG. 5). Each counterweight 44 has a centrally located hole 46 as illustrated in FIG. 4. The counterweights 44A, 44B, 44C, and 44D are stacked and stored with the pivot post 38 passing through the hole 46A, 46B, 46C, and 46D in each counterweight 44 (FIG. 5). The total weight attached to a second end 48 of the lift cable 20 is determined by adding the counterweight carrier 42 weight to the combined weight of the individual counterweights 44 that are supported by the counterweight carrier 42. The second end 48 of the lift cable 20 is attached to the counterweight carrier 42 with a swivel connector 50. The counterweight carrier 42 moves in a vertical direction and rides in the vertical guide 52 and the vertical guide 54.

FIG. 2 illustrates a cross-sectional view of the tower assembly 24 taken along line 2—2 of FIG. 1. The tower assembly 24 includes a tower post 56 and a tower post 58. A guide wall 60 and a guide wall 62 are rigidly attached to the tower post 56 forming the vertical guide 52. A guide wall 64 and a guide wall 66 are rigidly attached to the tower post 58 forming the vertical guide 54. The counterweight carrier 42 (shown in phantom) rides in the guides 52 and 54.

FIG. 3 illustrates a side view of the counterweight carrier 42. The counterweight carrier 42 includes a hook 68 and a hook 70 to support the counterweights 44. In order to obtain a desired total counterweight, the operator can select one or more counterweights 44 to be lifted by the hooks 68 and 70. As illustrated in FIG. 4, each counterweight 44 can rotatably pivot about the pivot post 38. Each counterweight is selected for lifting by rotating the counterweight 44 in a clockwise direction. In this position, the counterweight 44 is lifted by the hooks 68 and 70 (FIG. 5). Each counterweight can be rotated in a counter-clockwise direction to deselect the counterweight 44 for lifting. FIG. 4 illustrates a counterweight 44 in a counter-clockwise deselected position. The selection process is accomplished in the lower portion of the vertical guides 52 and 54 where there are openings 72 and 74 to allow the counterweights 44 to be rotated. Guide wall 62 ends before reaching element 76 which creates the opening 72, and guide wall 64 ends before reaching element 76 which creates the opening 74 (FIGS. 4 and 5).

To add counterweight, the operator first rotates counterweights 44A, 44B, 44C, and 44D in a counter-clockwise direction. Weights are added for lifting by the counterweight carrier 42 by rotating in a clockwise direction successive counterweights 44 in the order of 44A, 44B, 44C, and 44D (FIG. 5). Weights are subtracted from the counterweight carrier 42 by rotating in a counter-clockwise direction successive counterweights 44 in the order of 44D, 44C, 44B, and 44A (FIG. 5). Therefore, in the preferred embodiment of the present invention, the operator engages counterweights 44 for lifting by rotation and, thus, never has to lift counterweights 44. This prevents back injuries and allows operators who are not physically strong to handle heavy counterweights 44. The combined weigh, of the counterweight carrier 42 and the selected counterweights 44 are preferably about the same weight of the cylinder being lifted. Individually selected counterweights 44 provide weight compensation for a full or empty cylinder 80.

In the present invention, each counterweight 44 weighs about 12 pounds and the counterweight carrier 42 weighs about 23 pounds. Empty cylinders 80 weigh between about 27 and 35 pounds each, and full cylinders 80 weigh between about 60 and 80 pounds each. Counterweights 44 are selected to counterbalance within about 10 pounds of the total weight of the cylinder 80. For stability and control, the 10 pound differential ensures that the cylinder, if left unattended, will always safely return to the ground. At the same time, the operator only has to provide about 10 pounds of force to lift the cylinder 80.

Figure 6:
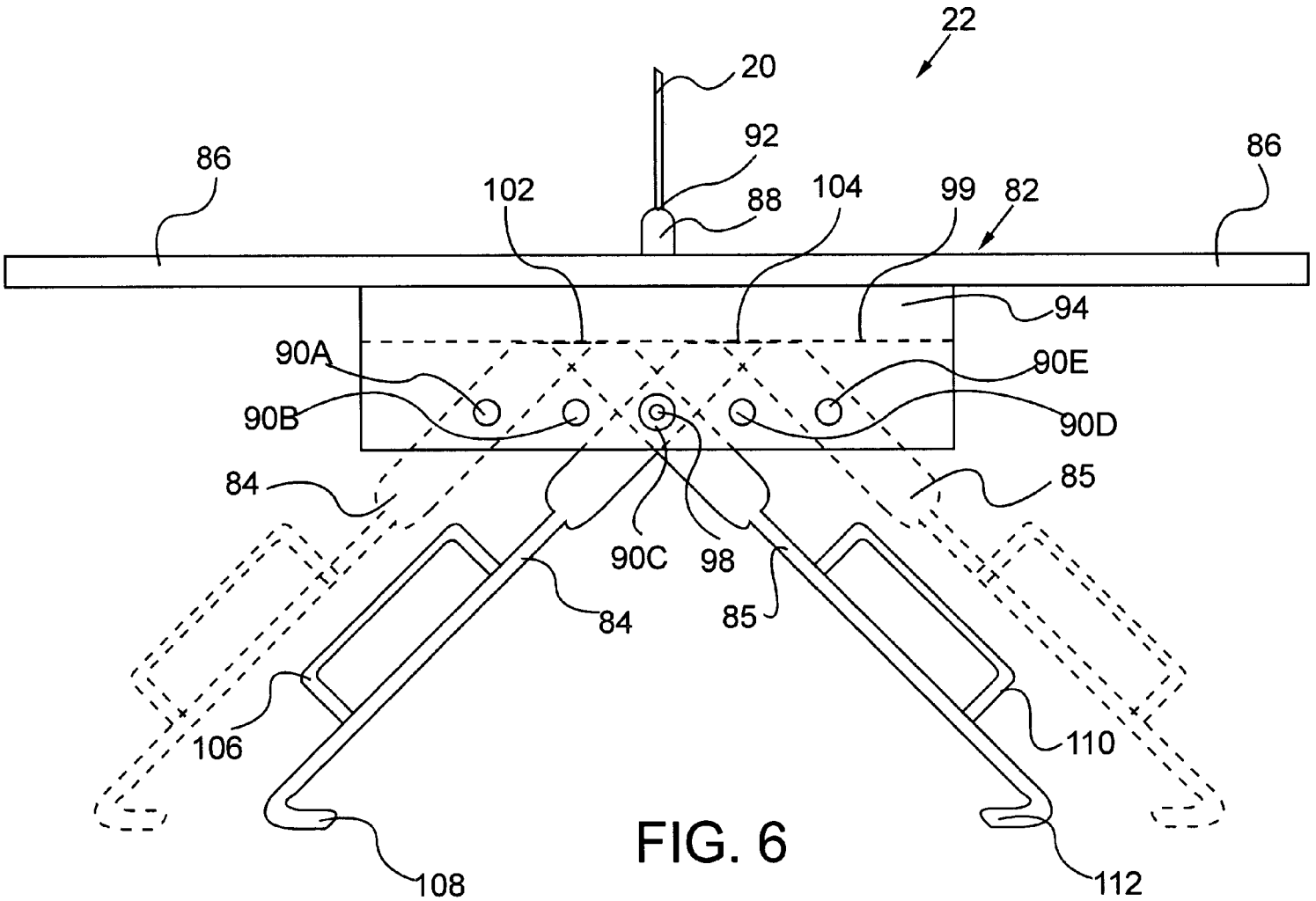
FIG. 6 illustrates a side view of a tong apparatus.
Figure 7:
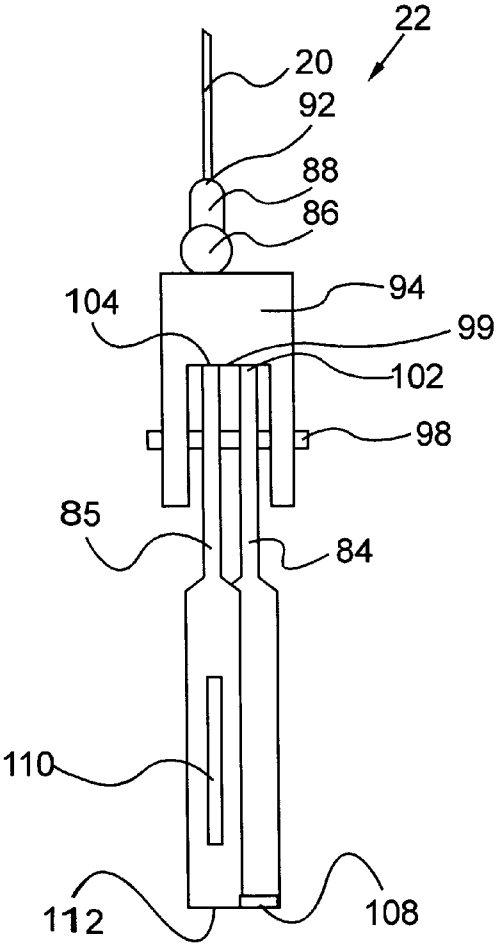
FIG. 7 illustrates an end view of the tong apparatus.
Figure 9:
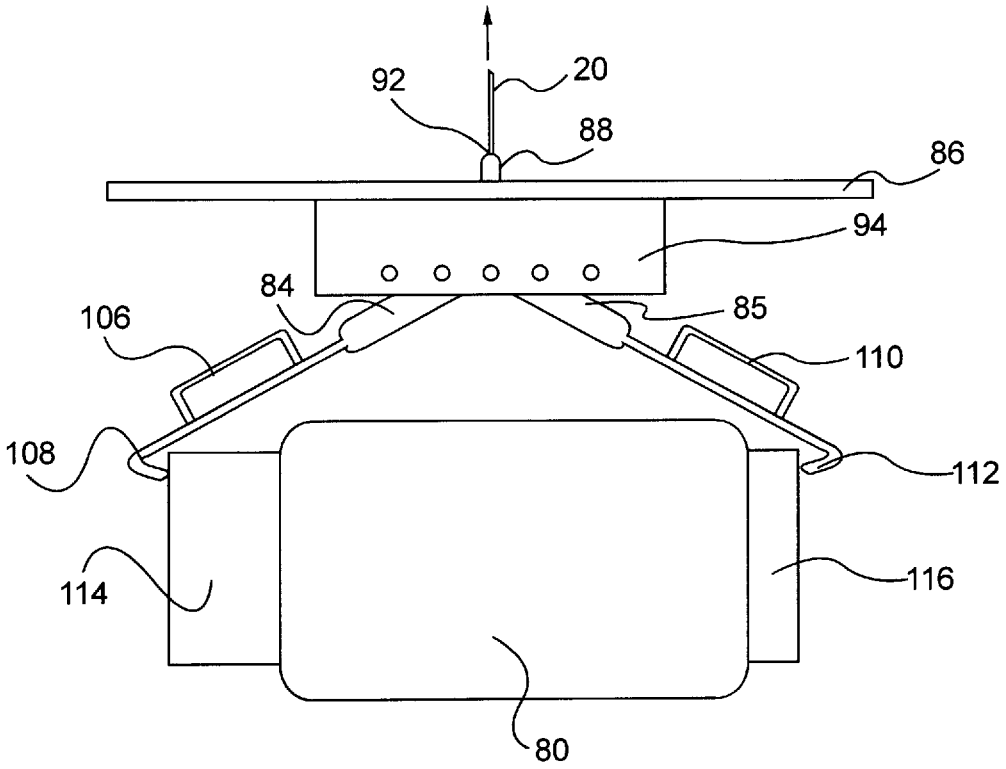
FIG. 9 illustrates a side view of the tong apparatus engaged with a cylinder.

The tong apparatus 22 for engaging a cylinder 80 is illustrated in FIGS. 6 and 7. FIG. 6 illustrates a side view and FIG. 7 illustrates an end view of the tong apparatus 22. The tong apparatus 22 includes a tong main body 82, a hook arm 84, and a hook arm 85. The tong main body 82 includes a guidance handle 86, a main support housing 94, and a loop 88 for attachment to a first end 92 of the lift cable 20. The lift cable 20 is swivelably attached to the loop 88. The guidance handle 86 is attached to the main support housing 94 and the loop 88 is attached to the guidance handle 86. The guidance handle 86 is grasped by the operator and is used to lift, lower and rotate the cylinder 80 into a desired location (FIG. 9).

As illustrated in FIG. 6, the hook arm 84 and the hook arm 85 are pivotally attached with a pivoting pin 98 to the tong main body 82 at a pivot hole 90C. The tong main body 82 includes a plurality of holes 90A, 90B, 90C, 90D, and 90E to enable the pivot locations for the hook arms 84 and 85 to be moved in order to accommodate different cylinder 80 lengths. For example, hook arm 84 is shown in phantom located at pivot hole 90A, and hook arm 85 is shown in phantom located at pivot hole 90E. The main support housing 94 includes an inner flat surface 99. The downward extent of travel of the hook arm 84 is determined when the flat end 104 of the hook arm 84 contacts the inner flat surface 99 of the main support housing 94. The downward extent of travel of the hook arm 85 is determined when the flat end 102 of the hook arm 85 contacts the inner flat surface 98 of the main support housing 94.

Figure 10:
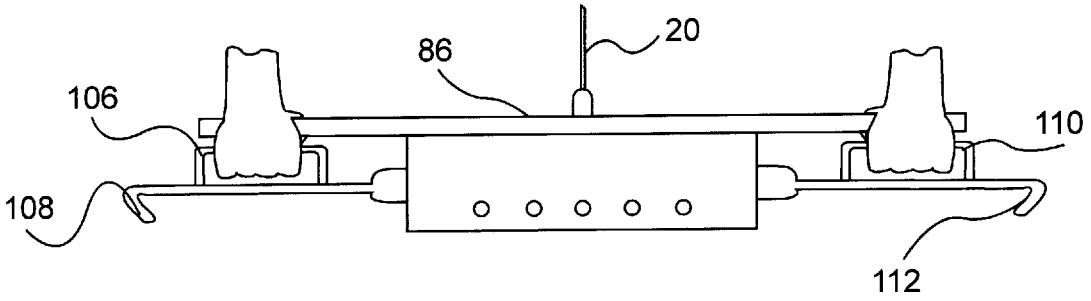
FIG. 10 illustrates a side view of each hook arm of the tong apparatus disengaged from a cylinder.

The hook arm 84 includes a control handle 106 and a cylinder hook 108. Similarly, the hook arm 85 includes a control handle 110 and a cylinder hook 112. FIG. 9 illustrates the cylinder hook 108 engaged in a first end 114 of the cylinder 80, and the cylinder hook 112 engaged in a second end 116 of the cylinder 80. When an operator lifts the cylinder 80 using the guidance handle 86, the counterweight apparatus 16 attached to the second end 48 of the lift cable 20 counterbalances the weight of the cylinder 80. As illustrated in FIG. 10, the operator releases the cylinder hooks 108 and 112 from engagement with the ends 114 and 116 of the cylinder 80 by pulling in an upward direction on the control handles 106 and 110. The operator can simultaneously grasp the control handles 106, 110, and the guidance handle 86 as illustrated in FIG. 10.

Figure 11:
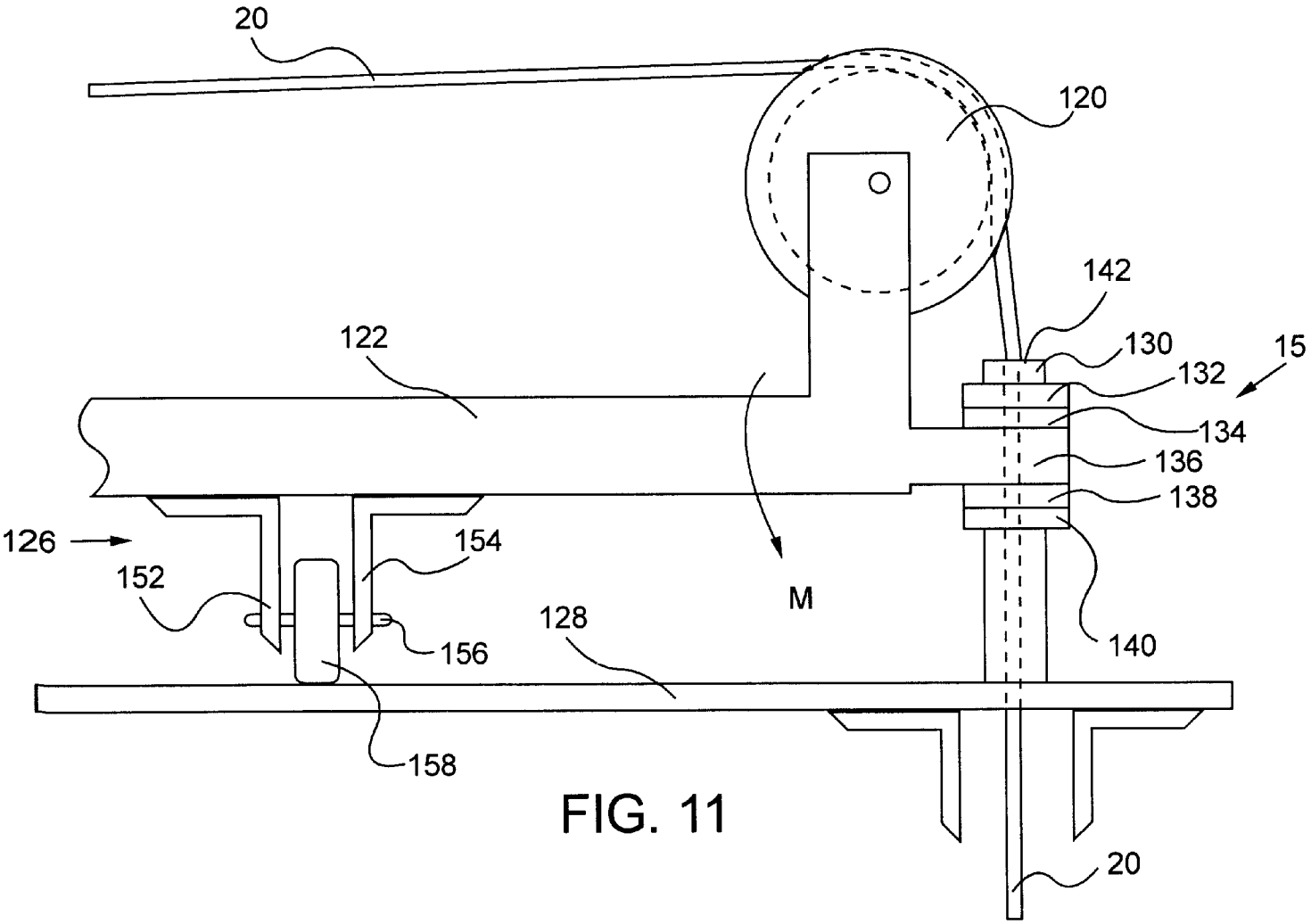
FIG. 11 illustrates a side view of a boom apparatus.
Figure 12:
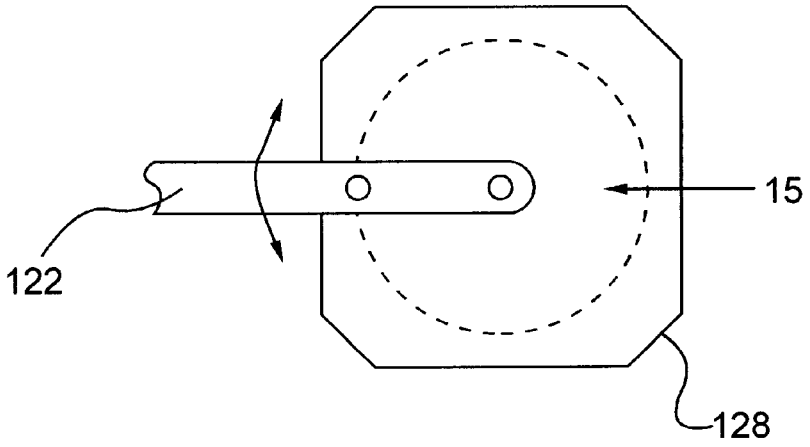
FIG. 12 illustrates a plan view of a support plate of the boom apparatus.

As illustrated in FIG. 1, the boom apparatus 14 is attached to the tower assembly 24. Further illustrations of the boom apparatus are included in FIGS. 11 and 12. The boom apparatus 14 includes a pivot apparatus 15, a sheave 120, a boom arm 122, a sheave 124, a wheel assembly 126, and a support plate 128 (FIG. 1 and 11). The boom arm 122 can pivot 360 degrees around the pivot apparatus 15 enabling the mobile lift 10 to move an object 360 degrees around the mobile lift (FIG. 12). The pivot apparatus 15 includes a pivot stud 130, a shaft collar 132, a thrust washer 134, a shaft collar 136, a shoulder bushing 138, and a shaft collar 140. A central vertical hole 142 passes through the pivot apparatus 15 and allows the lift cable 20 to pass through the pivot apparatus 15. The sheave 124 and the sheave 120 are pivotally attached to the boom arm 122, thereby allowing the cable to travel over the boom arm 122. An outer portion 150 of the boom arm 122 is located at a higher elevation to provide increased clearance between the boom arm 122 and the tong apparatus 22 (FIG. 1).

As illustrated in FIG. 11, the wheel assembly 126 includes support legs 152 and 154, a wheel axle 156, and a boom support wheel 158. The support legs 152 and 154 are attached to the boom arm 122 and support the wheel axle 156. The boom support wheel 158 rotates about the wheel axle 156, and contacts and rolls on the support plate 128. The boom support wheel 158 transfers a portion of the lifting load (i.e. cylinder 80 weight) and the boom arm 122 weight to the support plate 128, thus reducing the bending moment (M) applied to the pivot apparatus 15 (FIG. 11). As illustrated in FIG. 1, a first end 162 of a support 160 is attached to the support plate 128 and a second end 164 of the support 160 is attached to the main frame 26. The support 160 provides support to the support plate 128. A diagonal brace 161 is attached between the push handle 32 and the main frame 26 (FIG. 1).

As illustrated in FIG. 1, the first end 92 of the lift cable 20 is attached to the tong apparatus 22. Next, the lift cable 20 passes over the sheave 124, over the sheave 120, down through the central vertical hole 142, and down to the second end 48 of the lift cable which is attached to the counterweight apparatus 16.

As illustrated in FIG. 1, the wheel assemblies 18 are attached to the main frame 26. In the present invention, the main frame 26 is rectangular in shape and a wheel assembly 18 is attached near each corner 202A, 202B, 202C, and 202D of the main frame 26. Each wheel assembly 18 includes a pivotally mounted wheel 204, to assist the operator in moving the mobile lift 10 in any horizontal direction. A foot brake assembly 210 is attached to one end of the main frame 26. The foot brake assembly 210 includes a foot pedal 212, and a support pad 214. When the operator steps on the foot pedal 212, the support pad 214 moves in a downward direction and contacts a floor surface 216. When the support pad 214 contacts the floor surface 216, the mobile lift is held in one location while the operator lifts and moves a cylinder 80. When the operator lifts the support pad 214 away from the floor surface 216, the mobile lift 10 is once again free to move.

Figure 8:
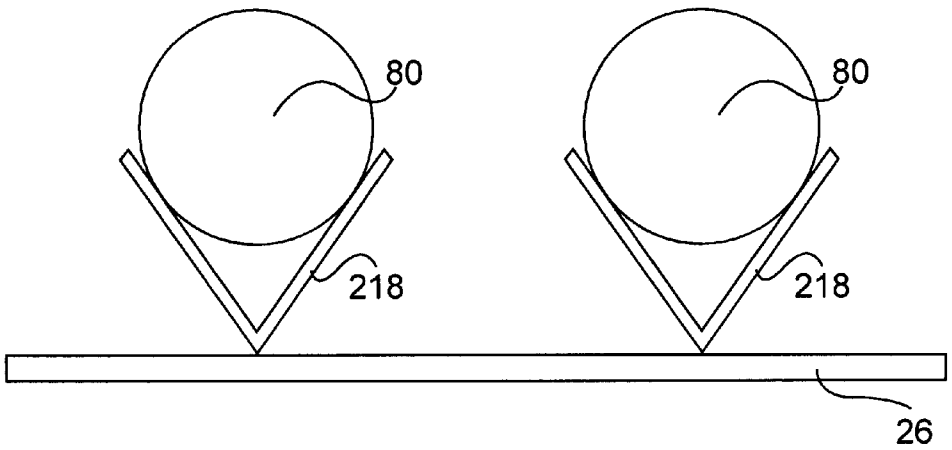
FIG. 8 illustrates an end view of cylinders resting on cradles attached to the mobile lift.

FIGS. 1 and 8 illustrate a plurality of cradles 218 supporting cylinders 80. The cradles 218 are attached to the main frame 26. In the preferred embodiment of the present invention, at least two cylinders 80 are supported by the cradles 218 on the main frame 26. The cradles 218 provide storage support for full and empty cylinders 80.

In accordance with the present invention, the operator rotates the boom arm 122 into a position over the cylinder 80 to be lifted. The operator rotates the required counterweights 44 for engagement with the hooks 68 and 70 of the counterweight carrier 42 (FIGS. 4 and 5). Next, the operator engages the cylinder hooks 108 and 112 with the cylinder 80 (FIG. 9). By grasping the guidance handle 86 of the tong apparatus 92, the operator can lift, move, and lower the cylinder 80 to the cradles 218 attached to the main frame 26. Next, the operator grasps the push handle 32 attached to the mobile lift 10 and moves the mobile lift 10 to a location where the cylinder 80 is required.

Figure 16:
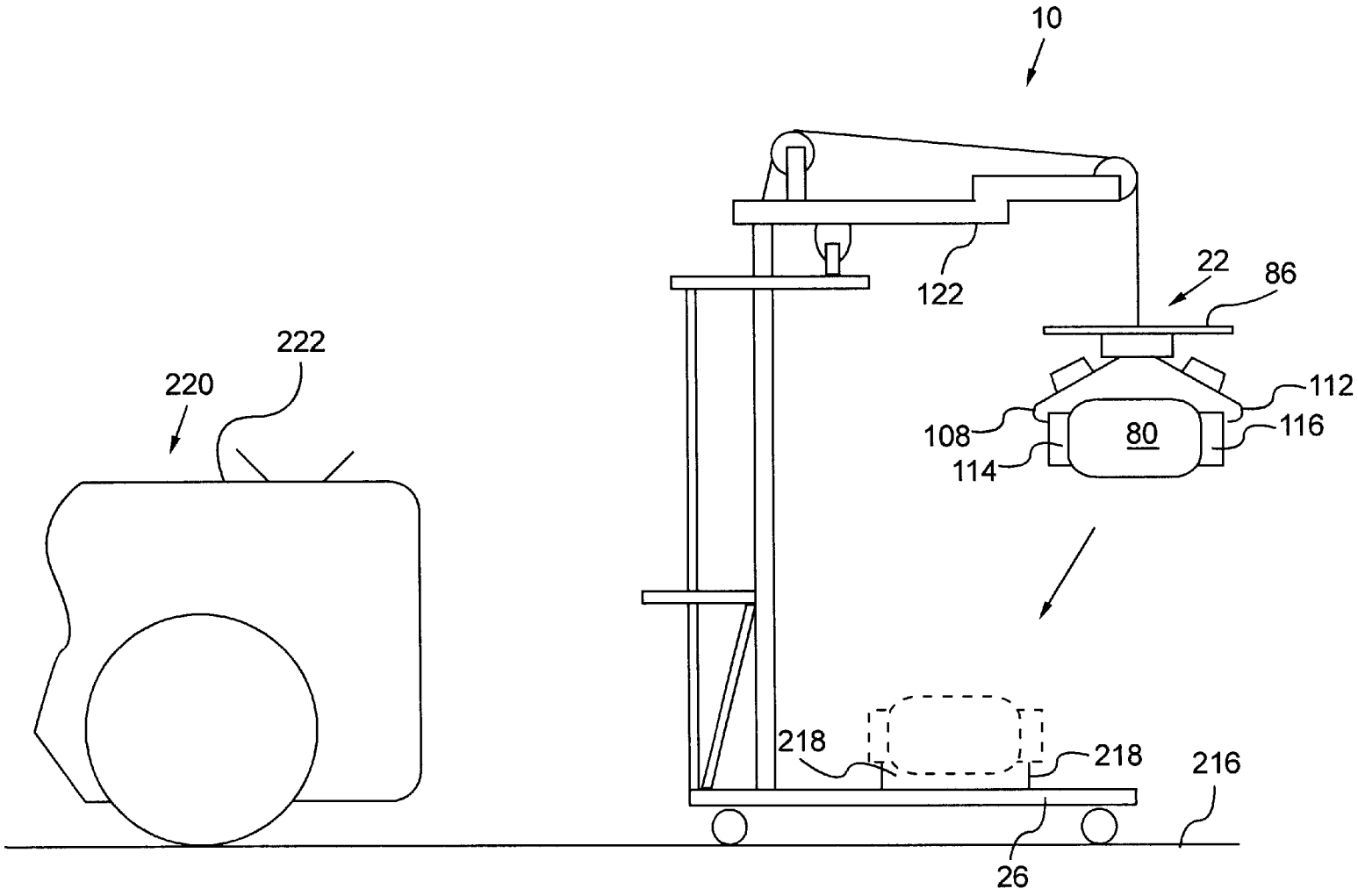
FIG. 16 illustrates a side view of the mobile lift transferring a cylinder from the mobile lift to a fork lift truck.
Figure 17:
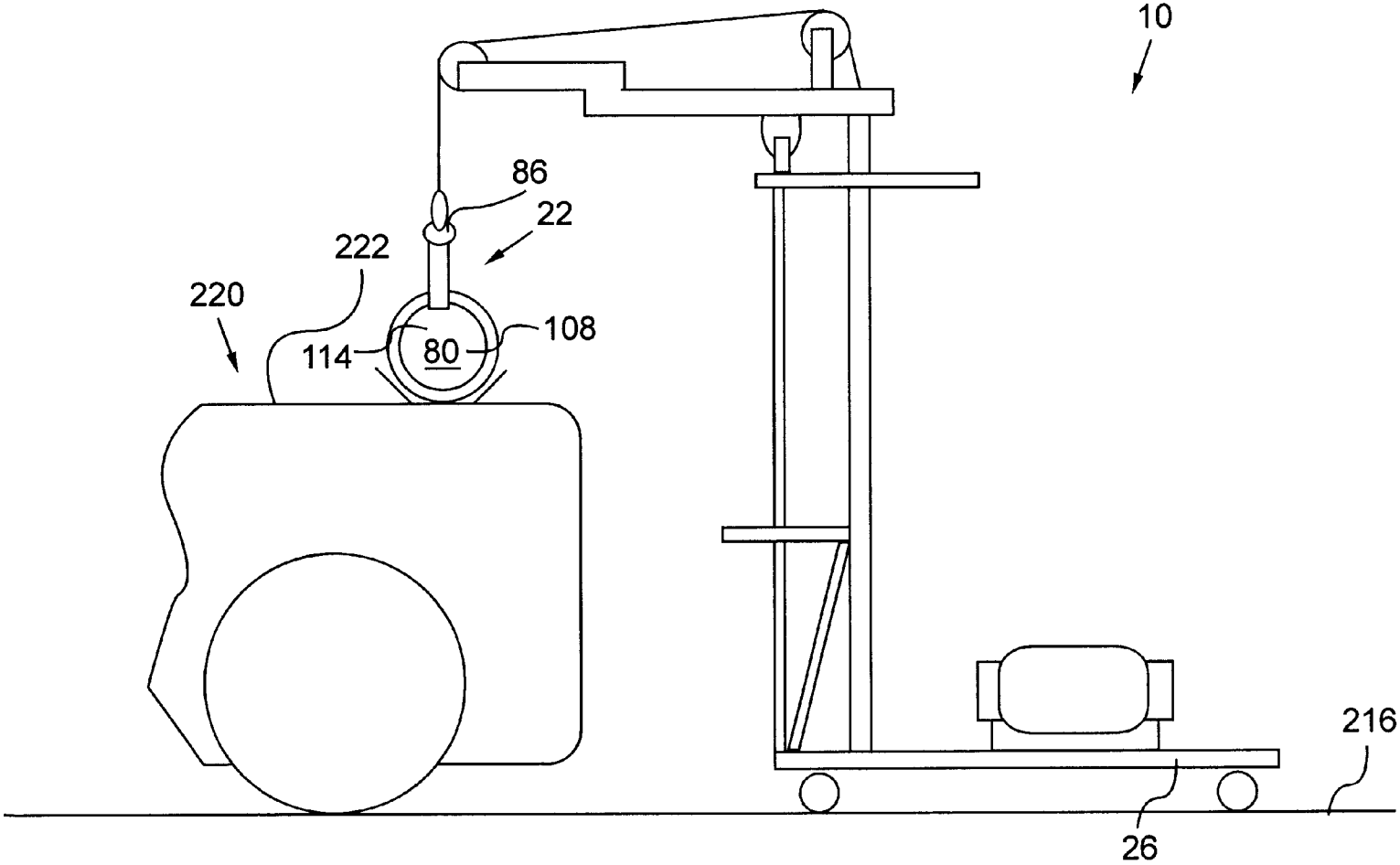
FIG. 17 illustrates the same view as FIG. 16, with a cylinder being placed on a platform of a fork lift truck according to a preferred embodiment of the present invention.

FIGS. 16 and 17 illustrate cylinders 80 being moved from a fork lift truck 220. For example, if the operator is replacing an empty cylinder 80 on a fork lift truck 220, the operator engages the cylinder hooks 108 and 112 of the tong apparatus 22 onto the ends 114 and 116 of the cylinder 80. The operator grasps the guidance handle 86 of the tong apparatus 22 and lifts, moves, and lowers the empty cylinder 80 to the cradles 218 on the main frame 26. The pivoting boom arm 122 allows the operator to easily move the empty cylinder 80 from a location above the fork lift truck 220 to a location above the empty cradles 218 on the main frame 26 (FIG. 16). Next, the operator reverses the process and uses the mobile lift 10 to lift, move, and lower a full cylinder 80 from the cradles 218 on the main frame 26 to a platform 222 on the fork lift truck 220 (FIG. 17).

Figure 13:
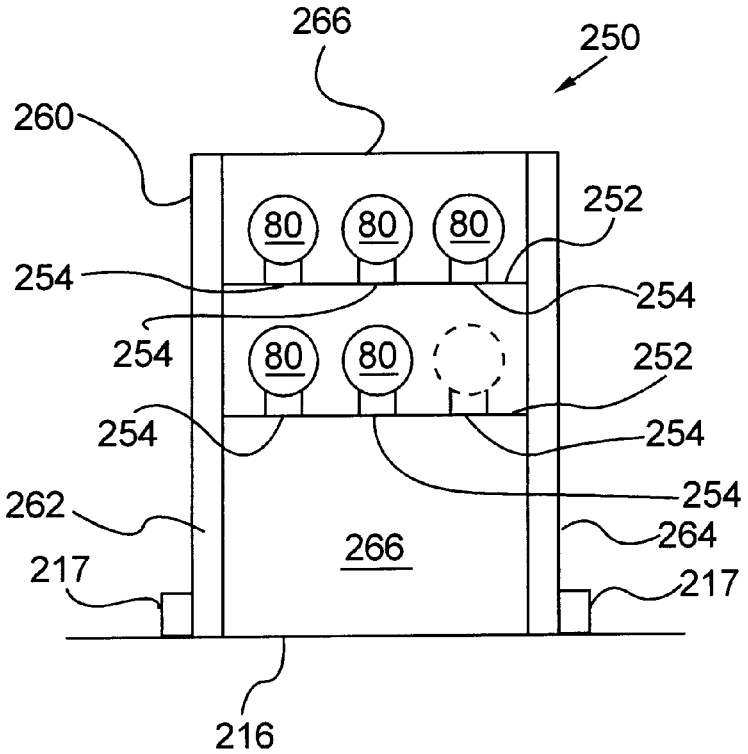
FIG. 13 illustrates a front view through an opening in the stationary storage apparatus with cylinders stored in cradles.
Figure 14:
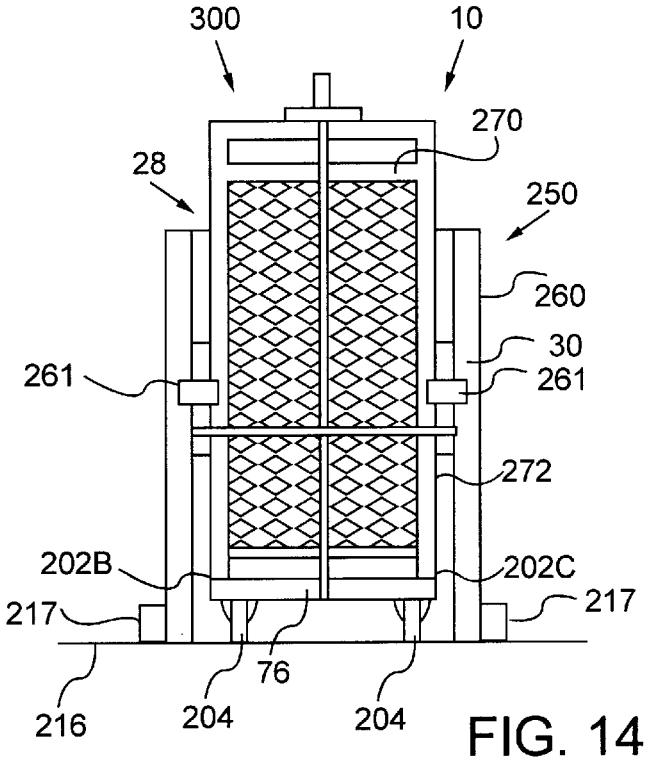
FIG. 14 illustrates the same view as FIG. 13, with a main wall of the mobile lift sealing the opening in the stationary storage apparatus forming a secure storage system.
Figure 15:
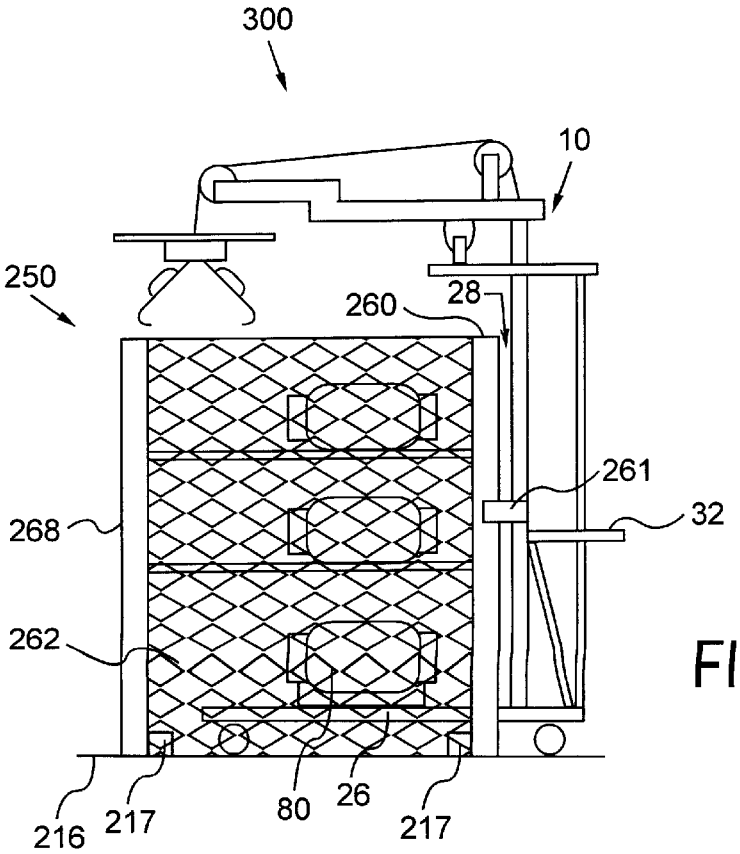
FIG. 15 illustrates a side view of the mobile lift attached to the stationary storage apparatus providing the secure storage system for the cylinders and for the mobile lift.

The operator then rolls the mobile lift 10 to a stationary storage apparatus 250. The stationary storage apparatus 250 is illustrated in FIGS. 13, 14, and 15. The stationary storage apparatus 250 provides a secure location where empty and full cylinders 80 can be stored. The stationary storage apparatus 250 can be anchored to the floor surface 216 by an anchoring apparatus 217, or the weight included in the stationary storage apparatus 250 may be sufficient to prevent movement. The stationary storage apparatus 250 includes racks 252 with cradles 254 for receiving and supporting a plurality of empty and full cylinders 80. The racks 252, cradles 254, and cylinders 80 are located inside a housing 260. The housing 260 includes three walls 262, 264, and 266, and rests on the floor surface 216. Therefore, the housing 250 includes a single opening 266 for receiving a portion of the mobile lift 10 (FIG. 13).

Included in the tower assembly 24 of the main body 12 of the mobile lift 10 is the main wall 28. As illustrated in FIGS. 1, 2, 4, and 14, the main wall 28 includes the fence 30 which is rigidly attached to the guide wall 62, the guide wall 66, a cross-brace 270, and a cross-brace 272. The operator can roll the mobile lift 10 into the opening 266 in the housing 260 of the stationary storage apparatus 250. As illustrated in FIGS. 14 and 15, the main wall 28 of the mobile lift 10 contacts the housing 260, thereby sealing the opening 266 in the housing 260. Specifically, the cylinders 80 on the mobile lift 10, and the cylinders 80 on the racks 252 of the stationary storage apparatus 250 are sealed within the housing 260. Therefore, if the main wall 28 of the mobile lift 10 is secured by a locking apparatus 261 to the housing 260, both the mobile lift 10 and the cylinders 80 are secured from theft (FIGS. 14 and 15). Therefore, the combination of the mobile lift. 10 and the stationary storage apparatus 250 form a stationary storage system 300 as illustrated in FIG. 15. Thus, the cylinders 80 are secured within the housing 260, and since the mobile lift 10 is locked to the stationary storage apparatus 250, the mobile lift 10 cannot be rolled away and stolen.

The foregoing description of the present invention has been presented for purposes of illustration and description. It is not intended to be exhaustive or to limit the invention to the precise form disclosed, and many modifications and variations are possible in light of the above teaching. For example, the mobile lift 10 of the present invention can be used to lift and transport a wide variety of objects such as boxes, mechanical parts, etc. The counterweights 44 can be sized and constructed of different materials (i.e. aluminum, steel, copper, etc.) to provide counterbalance to the load being lifted. The tong apparatus 22 can be replaced with other load attaching devices such as hooks, grippers, magnets, etc. A ballast apparatus 290 (FIG. 1) providing adjustable weight can be attached to the main frame 26. The ballast apparatus 290 can prevent the mobile lift 10 from tipping when the boom arm 122 is extended toward the push handle 32 end of the mobile lift 10. The wheels 204, may be turned by a motor (i.e. electric or gas) to propel the mobile lift 10 across a floor surface 216. Such modifications and variations that may be apparent to a person skilled in the art are intended to be included within the scope of this invention as defined by the accompanying claims.

I claim:

1. A mobile lift comprising:

a main body;

a rotatable boom apparatus;

a tong apparatus for engaging an object to be lifted;

a counterweight apparatus including a plurality of rotatably selectable counterweights for counterbalancing a weight of the object to be lifted; and a cable traversing the boom apparatus wherein a first end of the cable is attached to the tong apparatus and a second end of the cable is attached to the counterweight apparatus.

2. The mobile lift according to claim 1, further including a plurality of wheel assemblies attached to the main body to facilitate movement across a floor.

3. The mobile lift according to claim 1, further including a main wall attached to the main body for sealing an opening in a stationary storage apparatus.

4. The mobile lift according to claim 1, wherein the rotatable boom apparatus provides 360 degrees of rotation.

5. The mobile lift according to claim 4, wherein the rotatable boom apparatus further includes a boom support wheel rolling on a support plate to transfer load from a boom arm to the main body.

6. The mobile lift according to claim 1, wherein the tong apparatus further includes:

a tong main body;

a guidance handle attached to the tong main body for providing directional control;

at least two hook arms;

a pivotal attachment for pivotally attaching each hook arm to the tong main body;

a hook formed on a first end of each hook arm for engaging the object to be lifted; and a control handle attached to each hook arm for lifting and disengaging the hook from the object being lifted.

7. The mobile lift according to claim 6, wherein the tong apparatus further includes a surface formed on a second end of each hook arm for contacting a surface in the tong main body for limiting downward travel of the hook arm.

8. The mobile crane according to claim 1, wherein the counterweight apparatus further includes:

a counterweight carrier attached to the second end of the cable;

a plurality of counterweights each including a central hole;

a pivot post attached to the main body and protruding through the central hole in each counterweight for rotation of each counterweight;

a plurality of guides for directing the counterweight carrier and counterweights;

a plurality of openings in the guides for allowing the counterweights to rotate into a selected or a deselected position for engagement with the counterweight carrier; and at least two hooks formed in the counterweight carrier for engaging and lifting the counterweights.

9. The mobile lift according to claim 1, further including a push handle attached to the main body for moving the mobile lift.

10. The mobile lift according to claim 1, further including a foot brake assembly for selectively holding the mobile lift in a location.

11. The mobile lift according to claim 1, further including a plurality of cradles attached to the main body for securing objects to be lifted.

12. The mobile lift according to claim 1, wherein the object to be lifted is a cylinder.

* * * * *

UNITED STATES PATENT AND TRADEMARK OFFICE

CERTIFICATE OF CORRECTION

PATENT NO. : 5,993,136

DATED : November 30, 1999

INVENTOR(S) : Coleman W. Vickary

It is certified that error appears in the above-identified patent and that said Letters Patent is hereby corrected as shown below:

Col. 1, line 1

On the title page, Item [54] should read --MOBILE LIFT AND STORAGE APPARATUS--.

Signed and Sealed this

Twenty-ninth Day of August, 2000

*Attest:*

*Attesting Officer*

Q. TODD DICKINSON

*Director of Patents and Trademarks*